US006209296B1

(12) United States Patent
Perrone

(10) Patent No.: US 6,209,296 B1
(45) Date of Patent: Apr. 3, 2001

(54) MACHINE FOR ENROBING TABLETS WITH GELATIN AND DIE BLOCKS FOR USE THEREIN

(76) Inventor: Aldo Perrone, 7 Blue Jay Crescent, Brampton, Ontario (CA), L6T 3Z8

( * ) Notice: Subject to any disclaimer, the term of this patent is extended or adjusted under 35 U.S.C. 154(b) by 0 days.

(21) Appl. No.: 09/247,176

(22) Filed: Feb. 9, 1999

Related U.S. Application Data

(63) Continuation-in-part of application No. 09/059,144, filed on Apr. 13, 1998, now Pat. No. 6,018,935.

(51) Int. Cl.[7] ..... B65B 47/00
(52) U.S. Cl. ..... 53/560; 53/900
(58) Field of Search ..... 53/560, 559, 454, 53/453, 900, 546, 555, 554, 553

(56) References Cited

U.S. PATENT DOCUMENTS

| | | | | |
|---|---|---|---|---|
| 2,219,578 | | 10/1940 | Pittenger | 53/459 X |
| 2,387,747 | | 10/1945 | Cowley . | |
| 2,513,852 | | 7/1950 | Donofrio | 53/560 X |
| 2,663,128 | | 12/1953 | Stirn et al. | 53/900 X |
| 2,697,317 | | 12/1954 | Stirn et al. | 53/454 |
| 2,775,080 | | 12/1956 | Stirn et al. | 53/454 X |
| 2,775,081 | | 12/1956 | Stirn et al. | 53/454 X |
| 4,567,714 | | 2/1986 | Chasman | 53/438 |
| 4,571,924 | * | 2/1986 | Bahrani | 53/454 X |
| 4,817,367 | * | 4/1989 | Ishikawa et al. | 43/459 |
| 5,074,102 | | 12/1991 | Simpson et al. | 53/454 |
| 5,459,983 | | 10/1995 | Sadek et al. | 53/560 |
| 5,682,733 | | 11/1997 | Perrone | 53/560 |
| 5,761,886 | * | 6/1998 | Parkhideh | 53/454 |

FOREIGN PATENT DOCUMENTS 881022 11/1962 (GB) .

OTHER PUBLICATIONS

Packaging Technology Editorial Staff, "One–Piece Hard Gelatin Capsules—New Option For Pharmaceutical and Food Application," *packaging technology*, Mar./Apr. 1987, vol. 17, No. 2, pp. 6–8.

* cited by examiner

*Primary Examiner*—Eugene Kim
(74) *Attorney, Agent, or Firm*—Barry R. Lipsitz

(57) ABSTRACT

An apparatus for enrobing tablets in a gelatin layer includes a pair of die assemblies with each assembly including a rotatable, cylindrical die support and a series of die blocks mounted on this support for movement along a circular path. Each block has recesses formed in a top surface thereof and each recess of one assembly cooperates with a similar recess in the other assembly to form a cavity at a nip formed by the two assemblies. Each cavity is dimensioned to receive loosely therein one of the tablets. Two casting drums deliver gelatin strips to the die assemblies and each strip is pulled by one assembly into the nip. A time tablet dispensing mechanism is used to dispense tablets onto one of the strips at a feeding location. The preferred die blocks are made of hard plastics material. In one version of the apparatus, the blocks have substantially enclosed recesses except for their open tops and each block has one or more vacuum applying passageways including one with an open end at one end of the block. This version has two vacuum applying plate members each mounted adjacent a respective one of the die assemblies and connectible to a vacuum source.

21 Claims, 13 Drawing Sheets

MACHINE FOR ENROBING TABLETS WITH GELATIN AND DIE BLOCKS FOR USE THEREIN

This application is a continuation-in-part of U.S. patent application Ser. No. 09/059,144 filed Apr. 13, 1998, now U.S. Pat. No. 6,018,935.

BACKGROUND OF THE INVENTION

This invention relates to an apparatus for enrobing medicine and other ingestible tablets in a digestible film.

The pharmaceutical industry commonly provides drugs in the form of a capsule or tablet that can be readily swallowed by a person. The dosage form known as a tablet is solid and hard with a predetermined shape. Its active ingredients are held together with a suitable binder.

Recent U.S. Pat. No. 5,146,730 issued Sep. 15, 1992 to Banner Gelatin Products Corp. teaches a method and apparatus for producing medicine tablets that are enrobed in a gelatin coating formed by applying two layers of film to opposite sides of the tablet. Hard cores or preforms are dispensed on a self-timed basis into simultaneous contact with the two films which are supported on coacting rotary dies that come together to form a nip. The hard cores contact the films adjacent this nip at places which overlay recesses formed in the dies. The elastic films deform around each core and are sealed by the dies to each other. The dies then cut the covered cores from the films.

One of the difficulties of this known apparatus is that the rotary die members which are believed to be made of metal are quite expensive to manufacture. If one or both of the rotary dies should be damaged for any reason, it may be necessary to completely replace one or both of the rotary die members at a substantial cost. Furthermore, if this should occur and it becomes necessary to shut down a manufacturing operation until the one or more rotary dies are replaced, there is likely to be substantial additional expense and loss as a result of the shutdown in operations.

Recent U.S. Pat. No. 5,682,733 issued Nov. 4, 1997 to the present applicant describes another apparatus for enrobing tablets, which apparatus employs a main linked track of die blocks with each block having a number of recesses formed in its top surface. There is also a revolving cooperating die device which can be either another linked track or a cylindrical rotary die and this device also has a plurality of recesses, each of which is cooperable with a recess of similar size in the main linked track to provide an enclosed cavity capable of holding one of the tablets. A gelatin strip is delivered to the main linked track and moves along its upper path. A tablet dispenser drops tablets into depressions formed in this gelatin strip. A second gelatin strip is delivered to the apparatus and is laid over the first strip when the two strips reach a region of contact.

It is an object of the present invention to provide an apparatus for enrobing tablets in a layer of gelatin, which apparatus employs rotary die assemblies each with a series of die blocks and which apparatus can be repaired should it become damaged with reasonable speed and at less expense than the prior art rotary die members.

It is another object of the present invention to provide relatively inexpensive die blocks for use in an apparatus for enrobing ingestible tablets, these blocks being made of a hard plastics material and each having a number of similar recesses formed in the top.

It is a further object of the present invention to provide the aforementioned inexpensive die blocks for enrobing tablets, these blocks having one or more passageways for applying vacuum to the or each recess formed in the block. With these blocks vacuum can be used to pull the adjacent gelatin web into the recess, thereby forming a cup to receive the tablet.

SUMMARY OF THE INVENTION

According to one aspect of the invention, an apparatus for enrobing tablets in a gelatin layer includes a pair of cylindrical rotary die assemblies, each die assembly including a substantially cylindrical, rotatable die support and a series of die blocks mounted on the die support for rotation about a central axis of the die support. Each block has at least one recess formed in a top surface thereof and each recess of each die assembly is cooperable with a similar recess in the other die assembly to form a cavity at a nip formed by the die assemblies. Each cavity is dimensioned to receive therein one of the tablets. The blocks of at least one of the rotary die assemblies each have one or more vacuum applying passageways that open into the at least one recess. The apparatus also includes a drive system for rotating both die assemblies around their respective central axes so that the two series move in synchronism with each other. Feed apparatus delivers a gelatin strip of selected thickness and composition to each of the die assemblies. During use of the apparatus, each gelatin strip is pulled by a respective one of the die assemblies into the nip and is laid on a section of the series of die blocks of the respective die assembly. A tablet dispensing mechanism dispenses individual whole tablets onto one of the gelatin strips at a feeding location that is upstream of the nip. A vacuum applying device is mounted adjacent at least one of the rotary die assemblies and connectible to a vacuum source. The vacuum applying device extends from a first location adjacent the nip to a second location near the tablet dispenser and has a primary vacuum applying passageway extending therealong. A portion or portions of at least one of the gelatin strips is stretched in the recess by vacuum applied to the recess by the vacuum applying device and the one or more vacuum passageways in the respective block. Each dispensing tablet is held in a stretched portion of the gelatin strip as the tablet moves into the nip.

In a preferred embodiment, each die block of each series has a number of recesses arranged in one or more rows extending transversely of its respective die assembly and is made of a hard, plastics material.

According to another aspect of the invention, a die block for use in an apparatus for enrobing ingestible tablets of selected size and shape with a gelatin film has a top, a bottom and sides extending between the top and the bottom. There are a number of similar recesses formed in the top with each recess being dimensioned to receive loosely therein at least one half of one of the tablets. A raised rim extends about a perimeter of each recess for cutting a gelatin film laid over the top of the block during use of the block, which is made of hard, plastics material.

In a particularly preferred embodiment, the block is made of carbon fibre reinforced plastics material.

According to a further aspect of the invention, there is provided a die block for use in an apparatus for enrobing tablets of selected size and shape with an ingestible film, the block having a top, a bottom and sides extending between the top and the bottom. A number of similar recesses are formed in the top with each recess being dimensioned to receive therein at least one half of one of the tablets. A raised rim extends around a perimeter of each recess for cutting a gelatin film laid over the top of said block during use thereof.

Each recess has a bottom and at least one sidewall forming a substantially enclosed recess with an open top. The block has two opposite ends and one or more vacuum applying passageways opening into the recesses, including an initial passageway having an open end at one end of the die block.

The tablet dispensing mechanism can comprise a number of vacuum applying members arranged in a row extending transversely of the one die assembly and the transfer mechanism includes a slidable frame member on which the vacuum applying members are mounted.

Further features and advantages will become apparent from the following detailed description taken in conjunction with the accompanying drawings.

DETAILED DESCRIPTION OF PREFERRED EMBODIMENT

Figure 1:
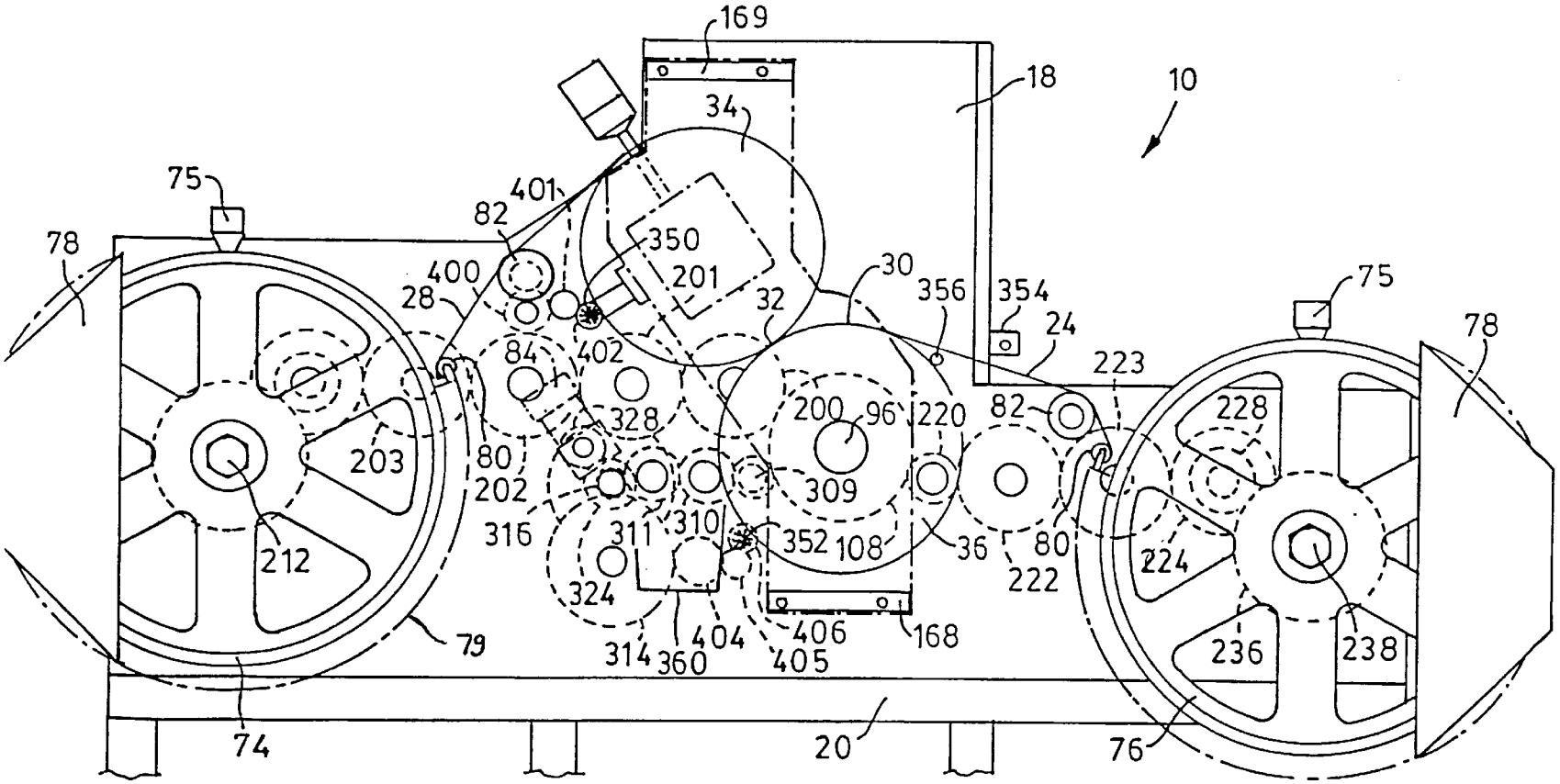
FIG. 1 is a front elevation of an apparatus for enrobing tablets, a front cover plate being shown in dot-dashed lines and the tablet feeding mechanism being omitted for sake of illustration.
Figures 2A, 2B:
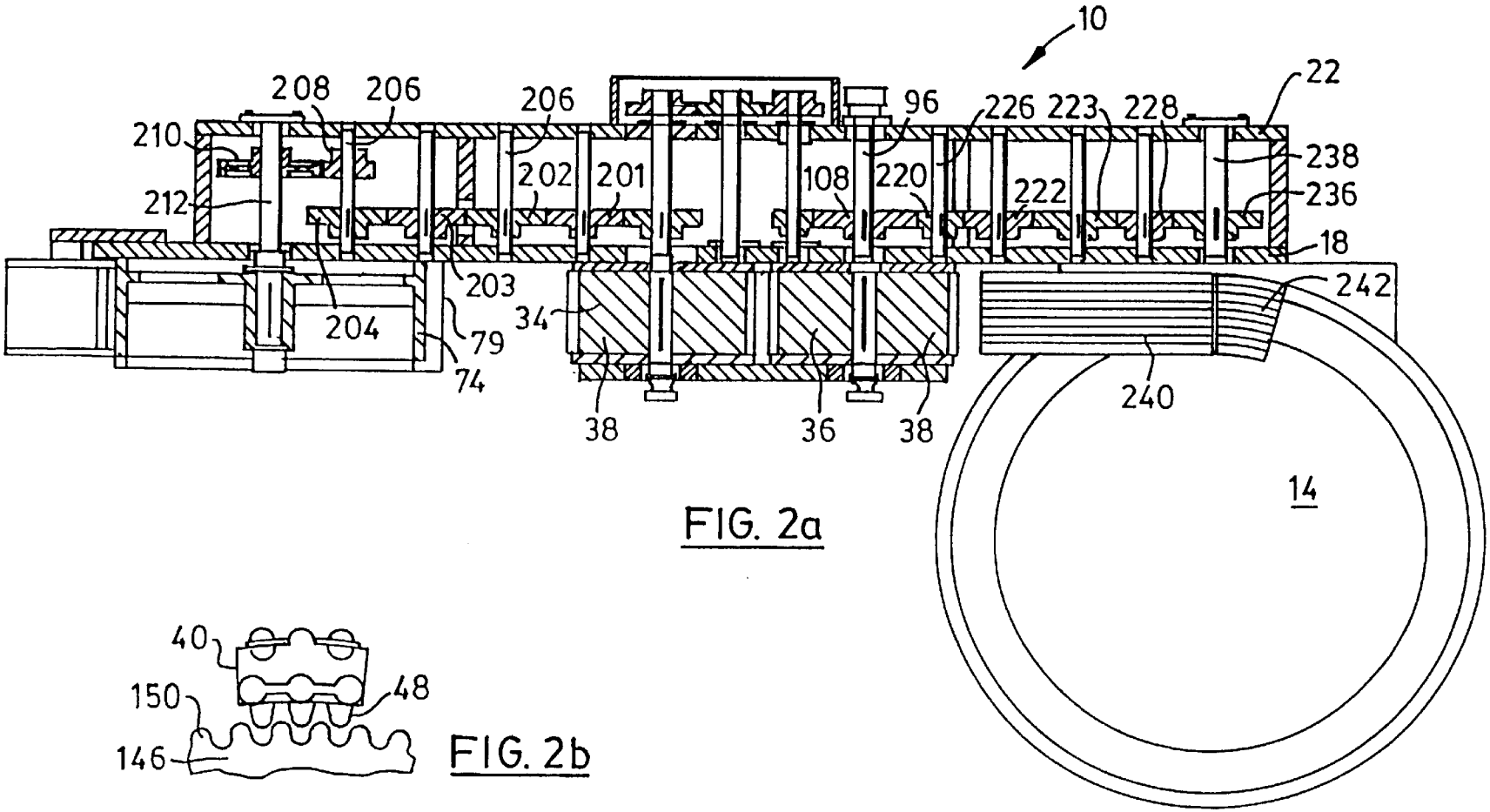
FIG. 2*a* is a top view, partly in cross-section showing front and rear support plates for the apparatus of FIG. 1, a bowl feeder, and chutes that feed tablets to the die assemblies.
FIG. 2*b* is a detail view illustrating the engagement between each die block and its cylindrical support.
Figure 3:
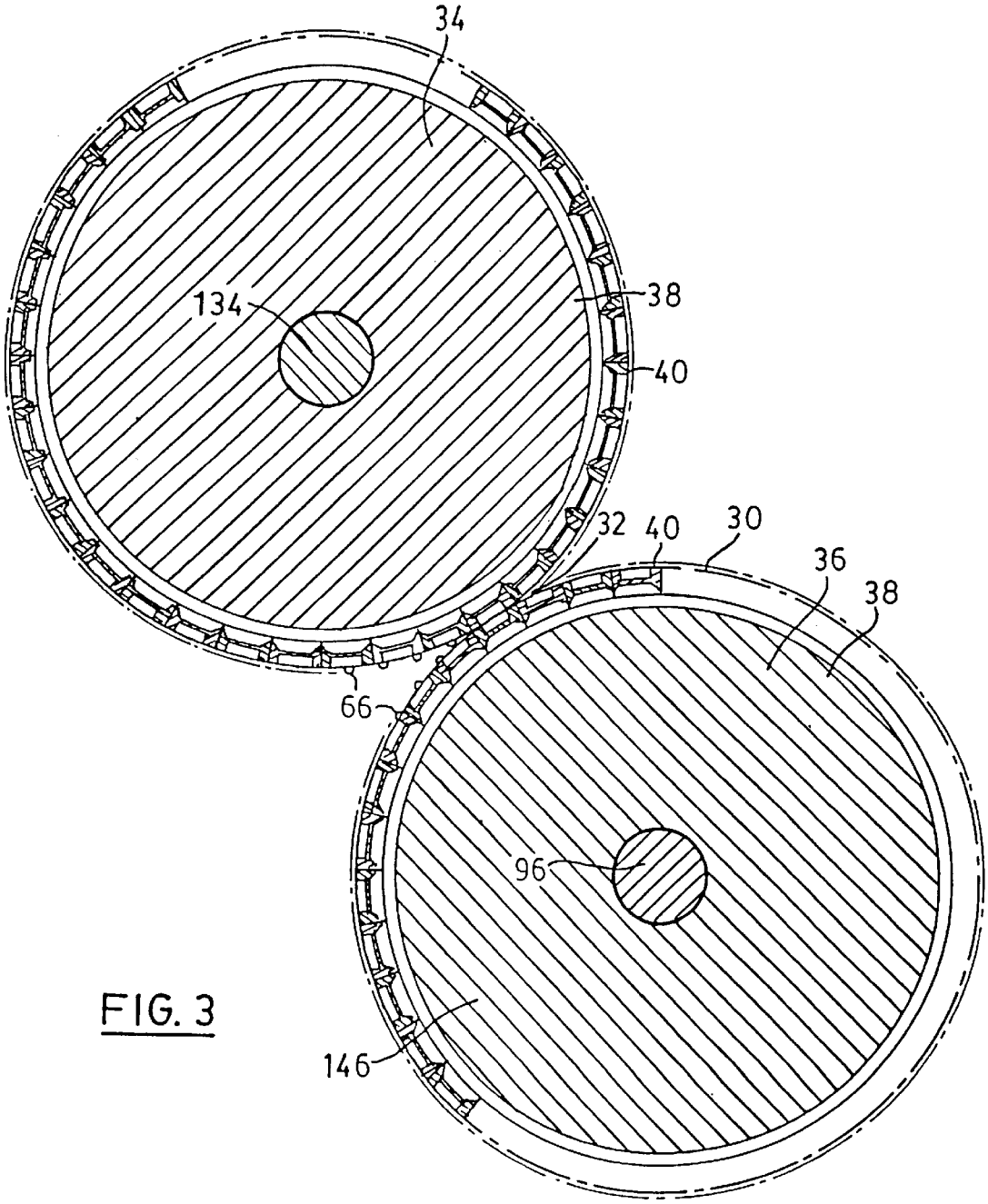
FIG. 3 is an elevational view in vertical cross-section showing the two die assemblies of the apparatus and the nip formed thereby.
Figure 12:
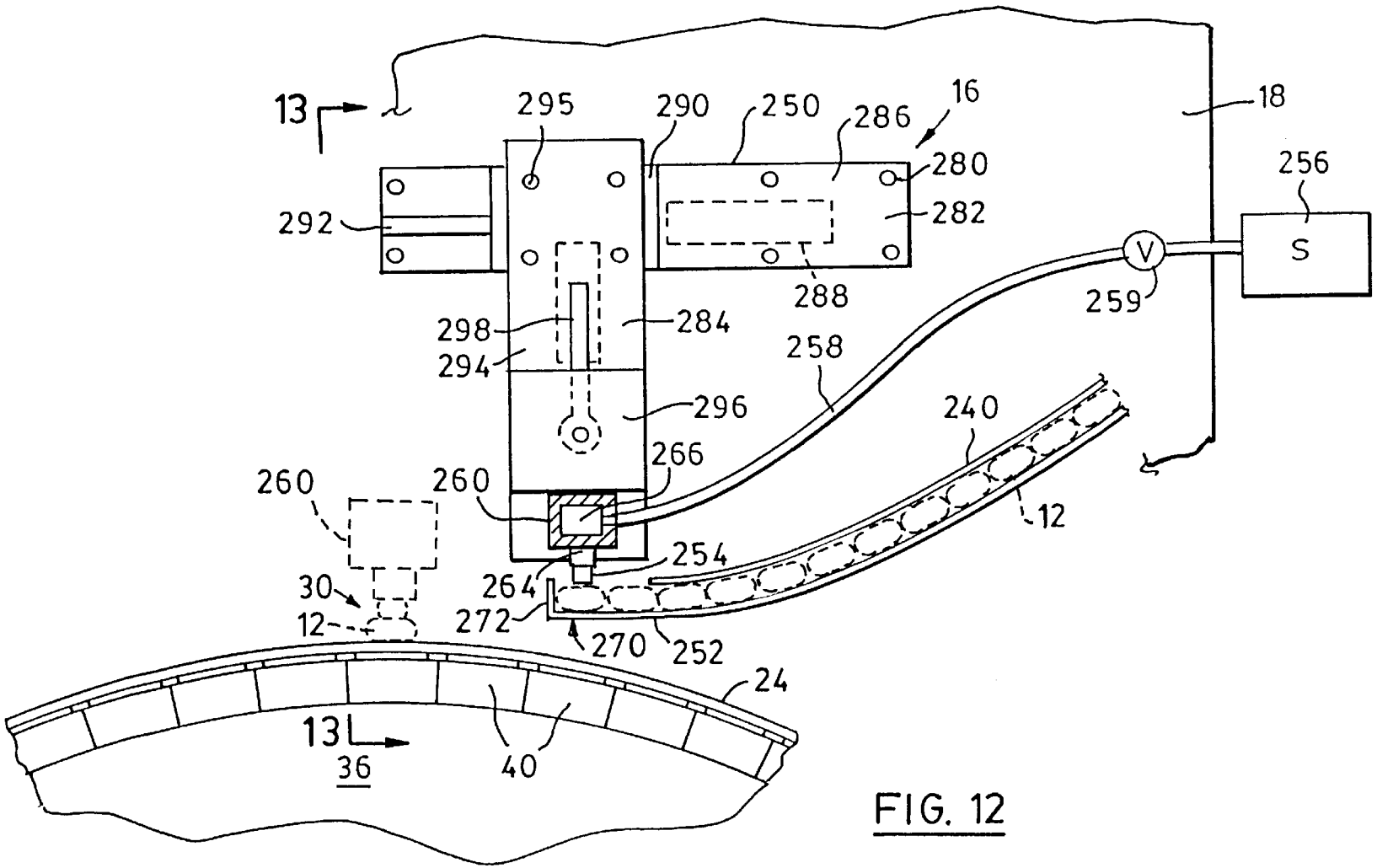
FIG. 12 is a side elevation showing one form of timed tablet dispensing mechanism that can be used in the apparatus of FIG. 1.
Figure 13:
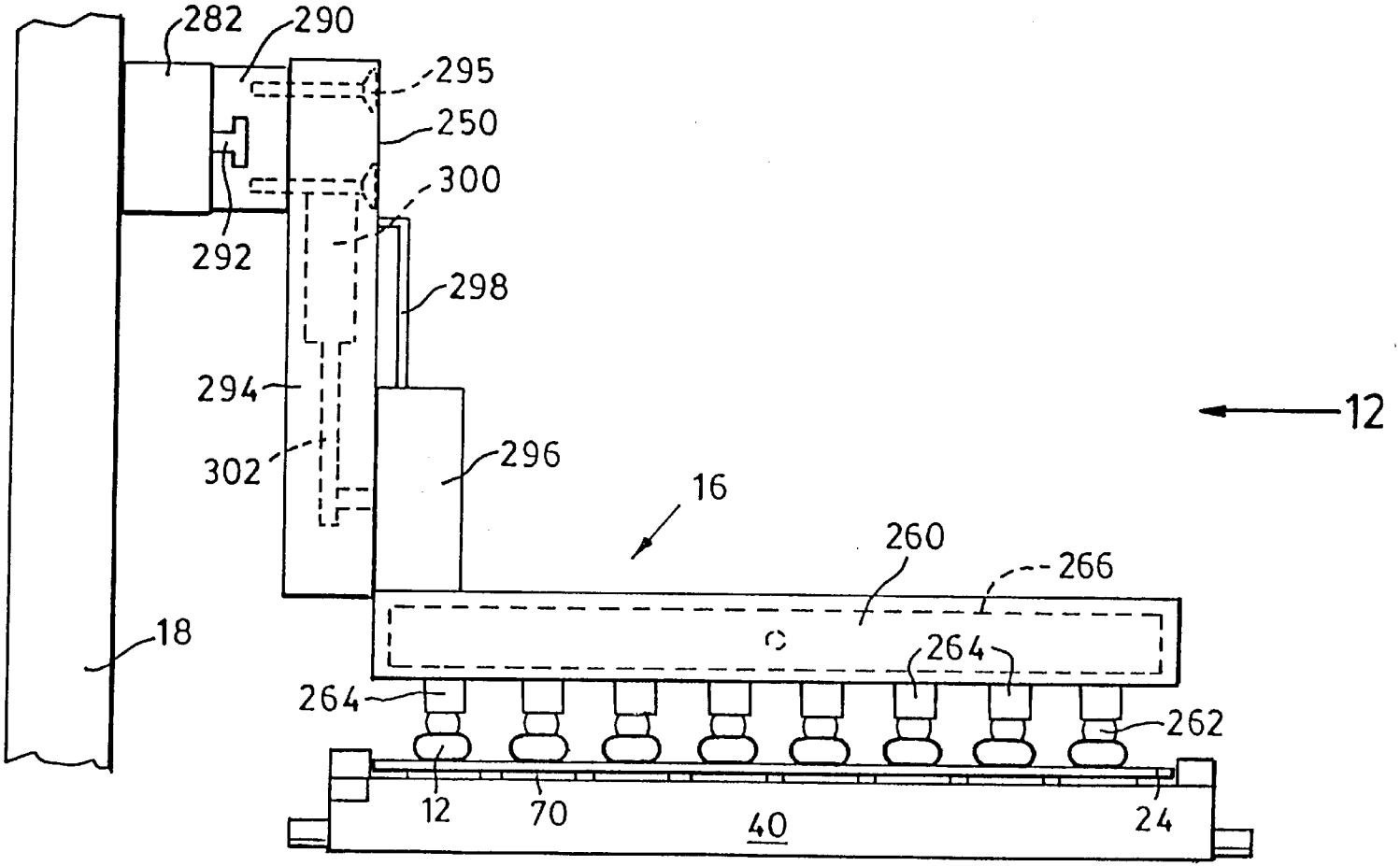
FIG. 13 is a front view of the tablet dispensing mechanism of FIG. 12.

FIG. 1 to 3 illustrate an apparatus 10 for completely enrobing medicine or similar ingestible tablets in a layer of gelatin, one of these finished tablets being shown at 12 in FIGS. 12 and 13. Not shown in FIG. 1 but shown in FIG. 2 is a bowl feeder 14 which per se is of known construction. Also, not shown in FIGS. 1 to 3 is a timed tablet dispensing mechanism, one form of which is shown in FIGS. 12 and 13. This timed tablet dispensing mechanism can be mounted rigidly on a front support plate 18 which extends vertically and which is rigidly attached to a rigid base structure 20 of suitable construction. The structure 20 supports the apparatus 10 on a floor or other suitable horizontal surface and only part of the structure is illustrated. Extending parallel to the plate 18 is a rear support plate 22. These plates 18, 22 as well as other metal components and parts of the apparatus are generally made from aluminium or stainless steel due to health and cleanliness requirements for a machine of this type.

Figure 7:
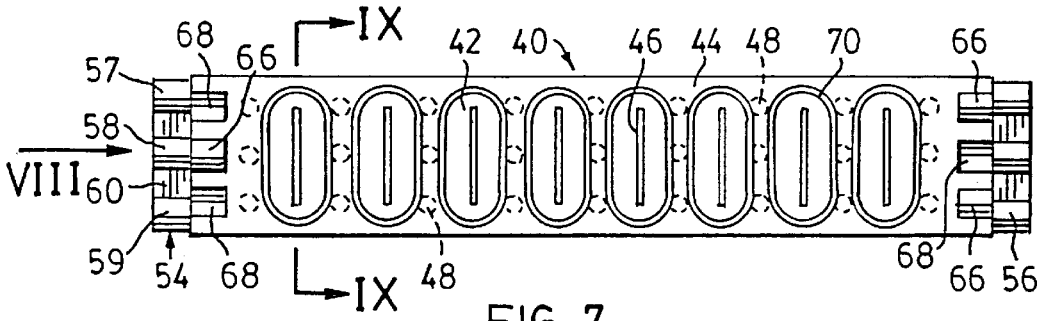
FIG. 7 is a top view of one form of die block usable on the two die assemblies shown in FIG. 3.
Figure 8:
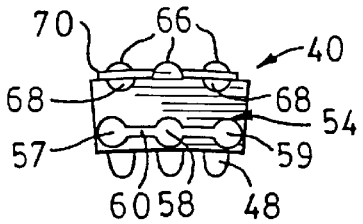
FIG. 8 is an end view of the die block of FIG. 7.
Figure 9:
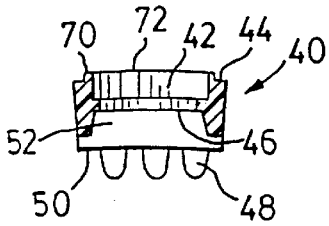
FIG. 9 is a cross-sectional view of the die block taken along the line IX—IX of FIG. 7.

Tablets made with the apparatus 10 are completely enclosed and sealed and comprise preforms supplied from the bowl feeder 14 and a gelatin coating made from two webs or films of gelatin indicated at 24 and 28. Individual preforms are dispensed onto the gelatin strip 24 at a feeding location indicated at 30 which, in a particularly preferred embodiment, is about 6 inches from a nip 32 formed by two cylindrical, rotary die assemblies indicated generally at 34 and 36. The two gelatin strips 24, 28 are brought together at the nip 32. The die assemblies each include a substantially cylindrical, rotatable die support 38 and a series of die blocks 40 mounted on the die support for rotation about a central axis of the die support 38. One of these die blocks 40 is illustrated in FIGS. 7 to 9 and it will be understood that all of the die blocks 40 on the two die assemblies can be of identical construction. For ease of manufacture and reduced costs, the die blocks 40 are preferably made of a durable, tough, hard plastics material and can be made by an injection molding process. A preferred form of plastics material is a carbon fiber reinforced plastics material. In one preferred embodiment of the apparatus 10, the blocks are made of carbon fibre reinforced, heat stabilized polyphthalamide (PPA). This preferred plastics material has a tensile strength of 46,500 psi (ASTM method D638) and a flexural strength of 64,500 psi (ASTM method D790).

Each die block 40 has at least one recess 42 formed in a top surface 44 thereof. It will be understood that each recess of each rotating assembly 34, 36 is cooperable with a similar recess 42 in the other rotating assembly to form a substantially enclosed cavity at the nip 32 formed by the rotating assemblies. This cavity is dimensioned to receive loosely therein one of the tablets 12. The illustrated die block 40 has a number of recesses 42 arranged in a single row that extends longitudinally of the die block and transversely of the block's respective die track 38. Although the illustrated die block is shown with only one row of recesses, it is of course possible to construct a die block with two or more rows of recesses, if desired. The illustrated recesses are substantially oval in shape in order to accommodate tablets of this general shape, but it will be understood that other shapes, for example, round, are also possible depending upon the shape of the tablets for which the apparatus is designed. In the first embodiment illustrated in FIGS. 7 to 9, slots or holes 46 can be provided in the bottom of the recesses in order to permit the escape of air from the recesses during the tablet encapsulating process. Each die block 40 is formed with two or more rows of teeth 48 on a bottom 50 thereof. In one embodiment of the block having eight recesses on top, there are nine rows of three teeth per row, each extending transversely of the elongate block. By employing this number of rows of teeth, one ensures that no undue load or stress will be placed on individual teeth as the blocks rotate with the die support.

Figure 10:
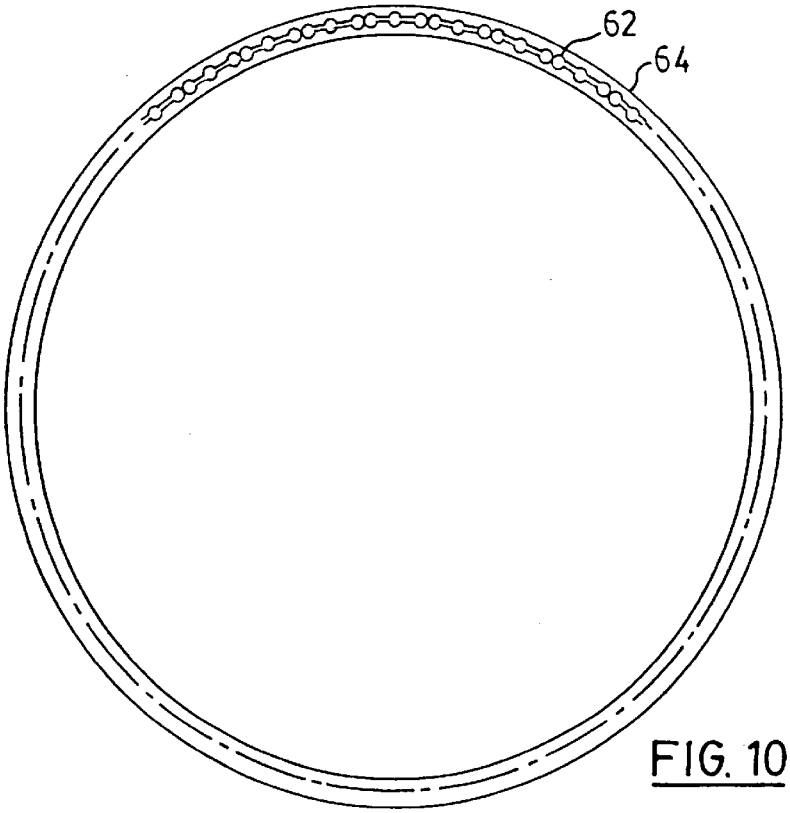
FIG. 10 is a side view of a metal bearing ring used to space the die blocks in the assembly, the ring being shown on the side facing the die blocks.

The die blocks 40 are formed with bottom cavities 52, the number and shape of which can correspond to the number and shape of the recesses 42. Two rows of the teeth 48 are located on each side of each cavity 52. Each die block is molded with laterally projecting connecting members 54, 56. In the illustrated embodiment, each of these connecting members comprises three, generally cylindrical protuberances 57, 58 and 59 and these are connected by integral webs 60. These connecting members 54, 56 extend respectively into a hole or holes 62 having a similar cross-sectional shape in a metal bearing ring 64, one of which is shown in FIG. 10. There are two of these rings 64 mounted in each die rotating assembly, one on each side of the series of die blocks. These rings, which can be made of bronze, act to connect together each series of die blocks so that they are uniformly spaced relative to one another about their respective die support. The rings are detachably connected to the die blocks as the connecting members 54, 56 are simply slid into their holes 62.

The preferred die block 40 also includes die locating members 66 that project upwardly from opposite ends of the top of the die block and help to align the die block with another cooperating die block of the apparatus during use thereof. In the block 40 as illustrated in FIG. 7, there is one central die locating member 66 at the left end and two members 66 at the right end. There are also die locating recesses 68 formed at opposite ends of the top of the die block 40. It is the combination of the members 66 and the recesses 68 which help to align the die block 40 with another cooperating die block. It will be understood that the recesses 68 are sized to receive the members 66 of the cooperating die block which will be arranged so that its end sections are the reverse of the end sections of the first die block.

A raised rim 70 extends about the perimeter of each recess 42 for cutting the gelatin web or strip 24, 28 after it is laid over the top of the block and is pulled into the nip 32. The top edge 72 of the rim should be slightly curved from one end of the recess to the opposite end to match the curvature of the circumference of the die support. In this way, opposing rims on opposing die blocks as they pass through the nip 32 will evenly and fully cut through the gelatin webs in order to encapsulate the tablet. Preferably, the rims 70 formed on the top of the die blocks 40 have a width from one to two times the thickness of the gelatin web which is laid over the recess. For example, for a small sized tablet or capsule, the width of the rim can be approximately 0.04 inch. The height of the rim 70 should be more than the thickness of the gelatin web.

Returning to FIG. 1, there is shown therein feed means for delivering a gelatin strip 24, 28 of selected thickness and composition to each of the die rotating assemblies 34, 36. The films or webs 24, 28 are cast on separate, rotating casting drums which per se are of known construction. These drums 74,76 can be made of stainless steel. It will be understood that the gelatin in a liquid state is delivered to each drum through a heated hose (not shown). Before use, the gel is stored in a jacketed tank that maintains the liquid gel at a temperature of at least 140 degrees F. By force of gravity, the liquid gel passes through the hoses to a spreader box 75 located at the top of each casting drum. The spreader box itself can be heated with two heating cartridges to maintain the liquid gelatin at a temperature of about 140 degrees F. The liquid gel is spread onto the casting drum which rotates and forms the gel into a ribbon or strip. A fan blower 78 is provided on each casting drum and acts to cool the gelatin so that it is changed into a solid strip that can be peeled from the casting drum at a small, adjustable roller 80. Preferably a metal cover 79 extends over the strip formed on the drum. The thickness of the gel strip can range from ten to thirty thousands of an inch. Each gel strip passes over a rotating oil roller 82 which applies a thin layer of oil on the outside surface of the strip. The oil helps to ensure the release of the gelatin strip from its respective die rotating assembly after the strip passes through the nip 32. The gelatin web 24 then extends to the lower die assembly 36 where it is laid on the die blocks 40 located at the top of the assembly. The gelatin web 28 extends to the upper die assembly 34 where it is placed over rotating die blocks extending across the top of the die assembly 34 and down one side thereof to the nip 32. After the two webs 24, 28 pass through the nip 32, they are adhered to each other and, in this state, they are pulled down through a scrap ribbon puller 84 which is shown in detail in FIGS. 6*a* and 6*b*. The used gelatin web can then be deposited in a suitable container (not shown) for subsequent disposal.

Figure 4:
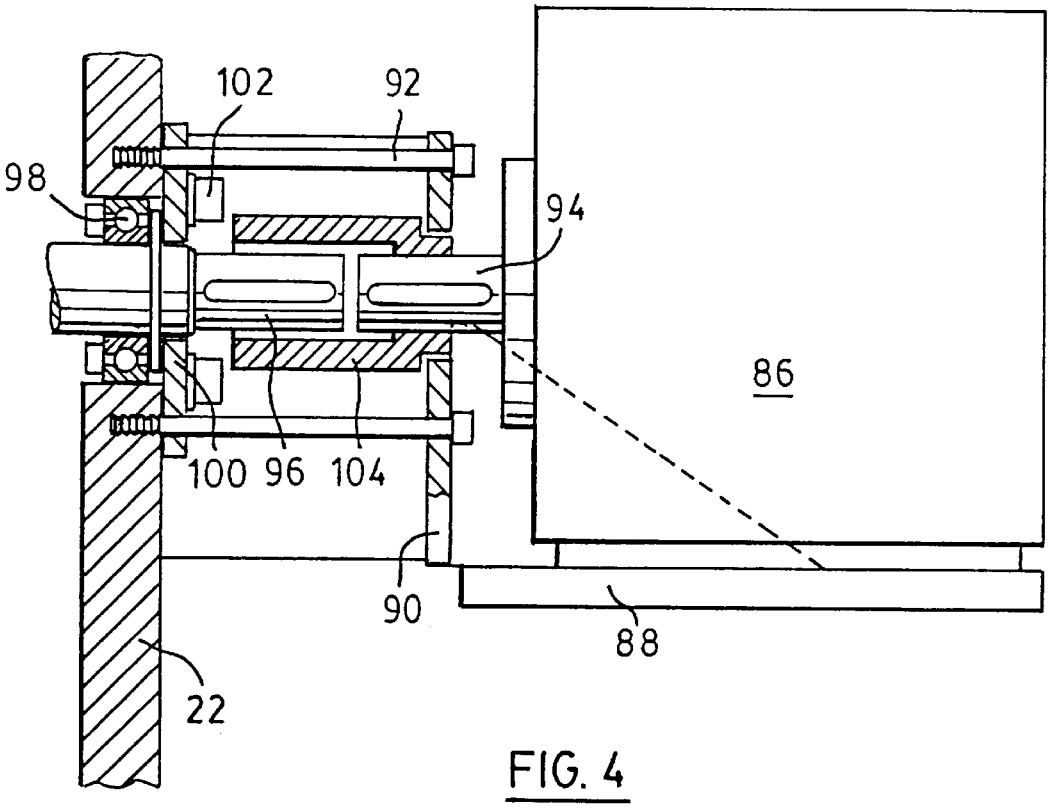
FIG. 4 is an elevational view, partly in cross-section, showing a drive motor and drive shaft for the apparatus.

A drive system is provided for rotating both die assemblies 34, 36 about their respective central axes so that the two series of blocks move in synchronism with each other. The start of the preferred drive system is shown in FIG. 4 and it begins with an electric motor 86. The illustrated motor is mounted on a horizontal support plate 88 but it is also possible to mount the drive motor on the floor. A vertically extending bracket 90 is used to secure the plate 88 to the main rear plate 22 which can be one inch aluminum or stainless steel plate. Four connecting bolts 92 extend between the bracket 90 and the rear plate 22. An output shaft 94 of the motor is connected to a main drive shaft 96 which is rotatably mounted in the rear plate 22 by means of ball bearings 98. These bearings are held in place by a bearing cover plate 100 and bolts 102. A standard shaft coupling 104 secures the motor shaft 94 to the shaft 96. It will be understood that if the motor 86 is mounted on the floor, suitable pulleys and a drive belt 97 can connect the motor output shaft 94 to the shaft 96. A drive of this type is shown in part in FIG. 5.

Figure 5:
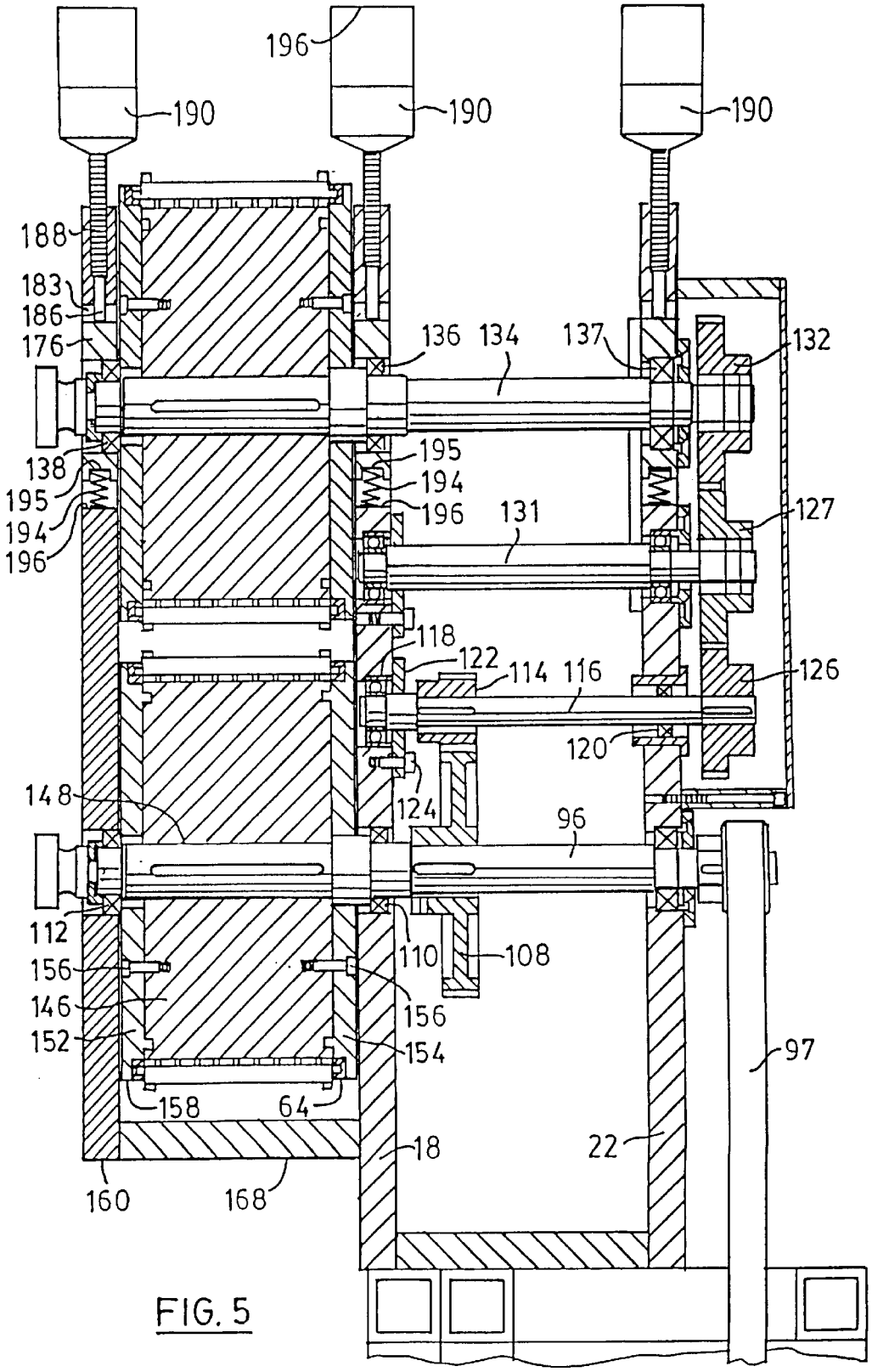
FIG. 5 is a cross-section taken along the line 5—5 of FIG. 1 showing details of the die assemblies.

With reference now to FIG. 5, the forward section of the main drive shaft 96 is shown extending through main drive gear 108. The forward section of the shaft is rotatably mounted in the front plate 18 which can also be one inch plate and in front bracket plate 160. Ball bearings 110, 112 rotatably support the shaft. The drive gear 108 rotates a smaller drive pinion or gear 114 mounted on horizontal shaft 116. The shaft 116 is supported in ball bearings at 118 and 120. The bearings 118 are secured in the front plate 18 by means of bearing cover plate 122 and connecting bolts 124. The shaft 116 which is made of stainless steel supports a drive gear 126 mounted to the rear of rear plate 22. Gear 126 engages a similar gear 127 mounted on rotatable shaft 131. The gear 127 operatively engages another similar gear 132 of equal size mounted on stainless steel drive shaft 134. The shaft 134 extends through the front and rear plates and a passageway formed along the central axis of the upper die assembly 34. The shaft 134 is rotatably supported by three ball bearings at 136, 137, 138. The two series of die blocks 40 and their cylindrical supports are rotated at the same speed. The central shaft 134 is used to properly position the die assembly 34 relative to the lower assembly 36.

A preferred construction of each die rotating assembly 34, 36, will now be explained with reference to FIGS. 3 and particularly FIG. 5. Reference will be made to die rotating assembly 36 shown in detail in FIG. 5 and it will understood that the assembly 34 is constructed in a similar manner. The main component of the die track is a solid, cylindrical aluminum block 146 through the center of which is a passageway 148 which accommodates the forward end section of the main drive shaft. A series of small, transversely extending teeth 150 are formed about the circumference of this block for engagement with the rows of teeth formed on the bottom of the blocks 40 (see FIG. 2*b*). In one preferred embodiment, the diameter of this block is eleven inches. The teeth 150 extend the width of the block 146 preferably. Connected to opposite sides of the block are two circular stainless steel side plates 152, 154 which can have a thickness of ¾ inch. These plates are rigidly connected to the block by means of connecting screws 156. An annular flange is formed about each plate 152, 154 at 158 in order to hold each bronze ring 64 in place.

The bottom end of the bracket plate 160 can be detachably connected to the front plate 18 by means of connecting plate 168 and suitable screws can be used for this purpose. A similar connecting plate 169 can connect the top of bracket plate 160 to the front plate.

Figure 11:
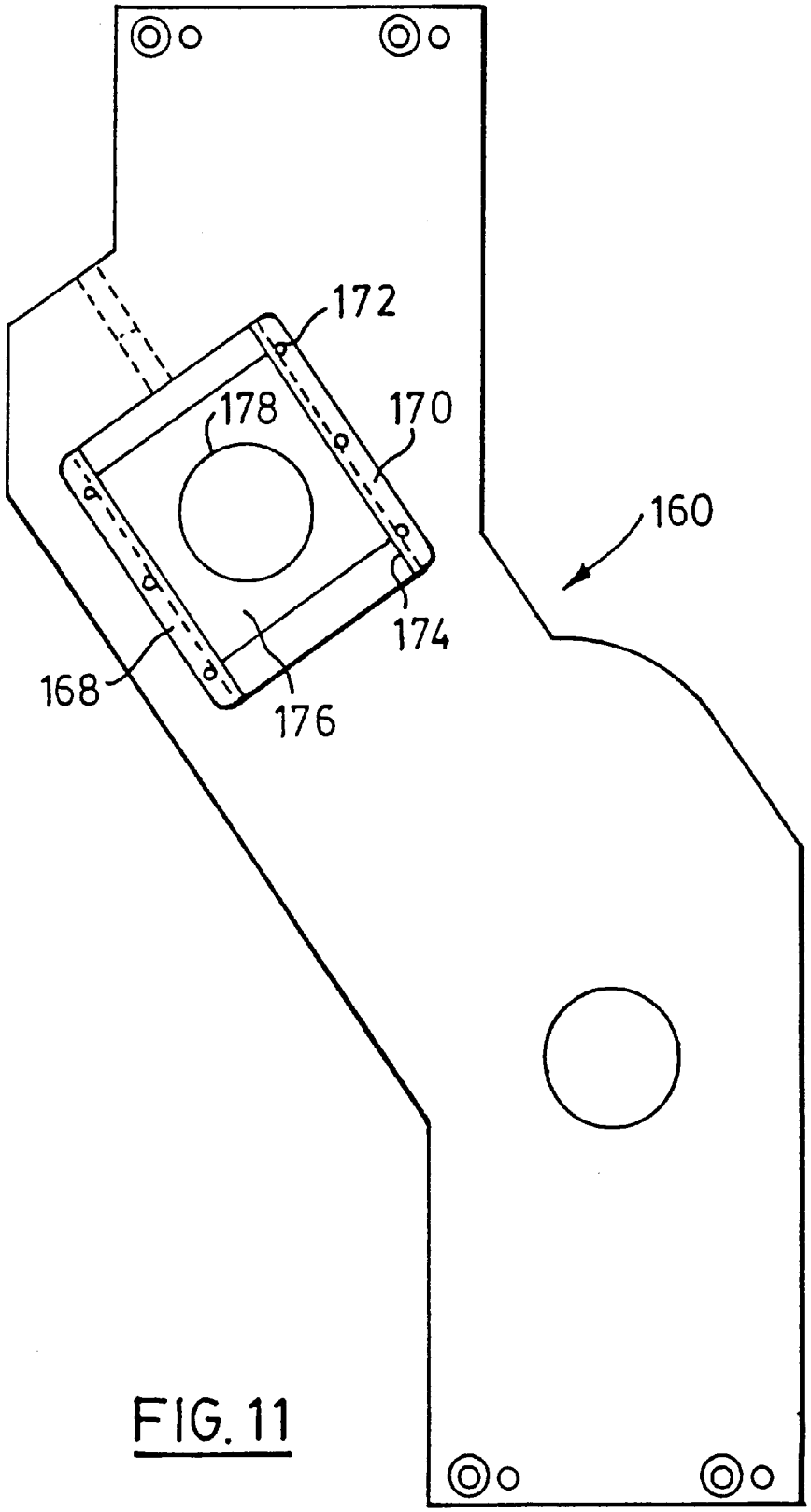
FIG. 11 is a front elevation illustrating the front bracket plate that covers the front of the rotary die assemblies.

The upper die rotating assembly 34 is adjustably mounted to the front plate 18 and the front bracket plate 160. The adjustable mounting for the shaft 142 is substantially the same on each of the plates 18, 22 and 160 and therefore reference will be made only herein to the adjustable support on the front bracket plate 160. As shown in FIG. 11, two straight, parallel guide plates 168, 170 are attached by screws 172 to the outer surface of the plate 160. The guide plates have an inner edge 174 that projects over a rectangular opening 183. These plates 168, 170 hold in a sliding fashion a rectangular support plate 176 having a central hole 178. This plate 176 is movable up or down in the opening 183 formed in the plate 160. The bearing 138 is mounted in the plate 176. Bearing on the top edge of each plate 176 is a pressure pin 186 that extends downwardly from the end of a threaded pin or screw member 188 that is part of a die plate pressure gauge 190. The preferred gauges 190 have a gauge dial (not shown) in their top end 192 which provides a pressure readout, this pressure being readable in psi. In a preferred embodiment, turning each pressure gauge in the clockwise direction puts further pressure on the top of the plate or slide 176. This plate and the attached die assembly move against the pressure of two or more coil springs 194, the upper ends of which can be accommodated in cylindrical cavities 195 formed in the bottom of the plate 182. The bottom end of each spring presses against support surface 196 in the bracket plate 160. As shown in FIG. 5, preferably three pressure gauges of similar construction are used in order to provide for fine adjustment of the position of the upper die assembly 34 and its shaft 134.

The preferred gear arrangement for rotating the two casting drums 74, 76 at the same rate and at the same time by means for the single main drive shaft 96 will now be described with particular reference to FIGS. 1 and 2. The shaft 96 rotates the main drive gear 108 shown in FIG. 5 and outlined in dotted lines in FIG. 1. This drive gear turns five identical idler gears 200 to 204 arranged in a horizontal row each of which is mounted on its own rotatable shaft 206. These shafts are mounted by means of ball bearings in rear support plate 22 and in the front plate 18 as shown in FIG. 2. Mounted on the last shaft 206 is a smaller gear 208 which rotates with the idler gear 204 and drives a larger gear 210. This gear is mounted on rotatable shaft 212 that rotatably supports the casting drum 74. It will be understood that the gear sizes are arranged to drive the casting drum at the required rotational speed upon rotation of the main drive shaft 96.

In order to drive the casting drum 76, the main drive gear 108 rotates a small idler gear 220 which then rotates three identical and in line idler gears 222 to 224. The gear 224 has been omitted from FIG. 2 for sake of illustration. Idler gears 222 to 224 are supported on their respective shafts 226 which are rotatably supported in front plate 18 and rear plate 22. Mounted on outer-most shaft 226 is a second, smaller gear 228 shown in outline in FIG. 1. The gear 228 in turn drives a larger gear 236 which is mounted on a relatively large shaft 238 on which the casting drum 76 is mounted. Thus rotation of the main drive shaft 96 also rotates the casting drum 76 and at the same speed as the drum 74.

Turning now to the means for dispensing tablets onto the gelatin strip 24, the aforementioned bowl feeder 14 is able to deliver properly oriented pills to a number of tablet chutes 240 which extend downwardly along a slope from the outlet of the bowl feeder located at 242. If there are eight recesses 42 formed in each die block, then there are eight separate chutes 240 which form eight sloping lines of tablets. The chutes are each sized to receive the preforms or tablets arranged in a single line and properly oriented and they are arranged side-by-side across the width of the die rotating assembly 36. Preferably the chutes are made of a slippery, non-abrasive material so that the preforms slide easily therealong. The inclination of the chutes should be sufficiently great that the preforms will slide easily under the force of gravity but not so great as to put any undue weight on the preforms at the bottom of the chutes. The chutes extend downwardly to a location near the feeding location 30 at the top of die rotating assembly 36. A first version of the tablet dispensing mechanism includes a tablet transfer device indicated generally at 250 in FIGS. 12 and 13. The illustrated device is able to move eight tablets 12 from a bottom section 252 of the chutes to the gelatin strip 24 which, at this time is supported by the die blocks 40. This transfer device includes vacuum applying members 254 used to pick up tablets 12 from their respective chutes and a vacuum source 256 indicated only schematically in FIG. 12. The vacuum source is operatively connected to the vacuum applying members by means of a vacuum line or hose 258 in which is mounted a suitable vacuum control valve 259. The end of the line 258 can be connected to a horizontally extending tubular support member 260 which can extend substantially the length of the adjacent die blocks, as shown in FIG. 13. The illustrated vacuum applying members include a rubber or rubber-like suction cup 262 sized to fit on top of the tablet 12 and a tubular metal cup connector 264 which is firmly connected to the bottom of the support member 260. A plenum chamber 266 inside support member 260 is enclosed and is evacuated by means of the vacuum line 258. Each vacuum applying member 254 is operatively connected to this plenum and accordingly vacuum is provided to each of the members 254 when required to pick-up a tablet. It will be appreciated that the valve 259 is provided to control the vacuum in the plenum and in the members 254 and air can quickly be supplied to the plenum and to the members 254, when required, to release the tablets onto the gelatin strip.

The tablets 12 are each picked up by a respective vacuum applying member 254 at a tablet pick-up position indicated at 270 in FIG. 12. This position is at the end of the tablet chute 240. The ends of the chutes are closed by vertically extending end wall 272 but the top of the end section of each chute is open to permit the lifting of individual tablets at the bottom end of the chutes. It will be understood that the tablet transfer device causes the vacuum applying member 254 to go through the following operational sequence. The members 254 with their flexible vacuum cups are positioned directly above the bottom tablets and they are then lowered into contact with the end tablets. Preferably the vacuum cup 262 is applied to the front portion of the top of the tablet 12. This is done to ensure that in the eventuality that the bottom tablet is cracked or split, the vacuum cup will always pick up at least the portion of the tablet at the very end of the chute, in other words, the portion adjacent to the end wall 272. Thus, any unwanted build up of pieces of tablets at the bottom end of the chutes is largely prevented.

After the vacuum cup has been lowered to the top of the pill, vacuum is generated in the plenum chamber 266, thus permitting the vacuum cup to grip the end tablet securely. The members 254 are then lifted together with the support member 260, the end tablets being raised sufficiently to clear the end wall 272. Then, the transfer device 250 causes the tablets with the support member 260 to be moved about one to one half inches horizontally and then the tablets and the member 260 are lowered so that the bottom of each tablet is just above the surface of the gelatin web. At the same time as the tablet reaches this position above the gelatin web, the vacuum in the plenum 260 is eliminated, thereby releasing the tablets 12. It will be understood that the operation of the tablet dispensing mechanism is synchronized with rotation of the die blocks, particularly the blocks on the assembly 36 so that each tablet 12 is released over a respective one of the recesses of the blocks.

The transfer device 250 shown in FIGS. 12 and 13 is firmly mounted by means of screws 280 to the front plate 18 and comprises first and second air cylinder drive devices with the first drive device 282 providing substantially horizontal movement and the second drive device 284 providing substantially vertical movement. Each of these drive devices can be of standard construction for such devices and therefore a detailed description herein is deemed unnecessary. Briefly, the horizontally extending first drive device 282 includes a rigid slide table 286 containing an air cylinder or air chamber indicated in dashed lines at 288. Slidingly mounted on this table is a rectangular support block 290. A guide rail 292 extends longitudinally along the center of the slide table 286 and extends along a slot or groove having a similar cross-sectional shape in the block 290. Movement of a piston member (not shown) in the air cylinder 288 causes the block 290 to move horizontally back or forth as required. The movable piston is connected to the block 290. The second vertical drive device 284 is constructed in a similar fashion and includes a vertically extending slide table 294 which is rigidly mounted to the block 290 by means of connecting bolts or screws 295. A rectangular support block 296 is slidably supported on the slide table and moves along a central, longitudinal rail 298. Again, an air cylinder 300 is provided in the table 294 and a piston member 302 slidable in this cylinder is connected to the support block 296. It will be understood that both of the drive devices 282 and 284 are connected to pressurized air hoses (not shown) which provide pressurized air to these drive devices in order to operate same. The support block 296 is firmly and rigidly connected to tubular support member 260 and is thus able to move the member 260 upwardly or downwardly when required.

Figure 14:
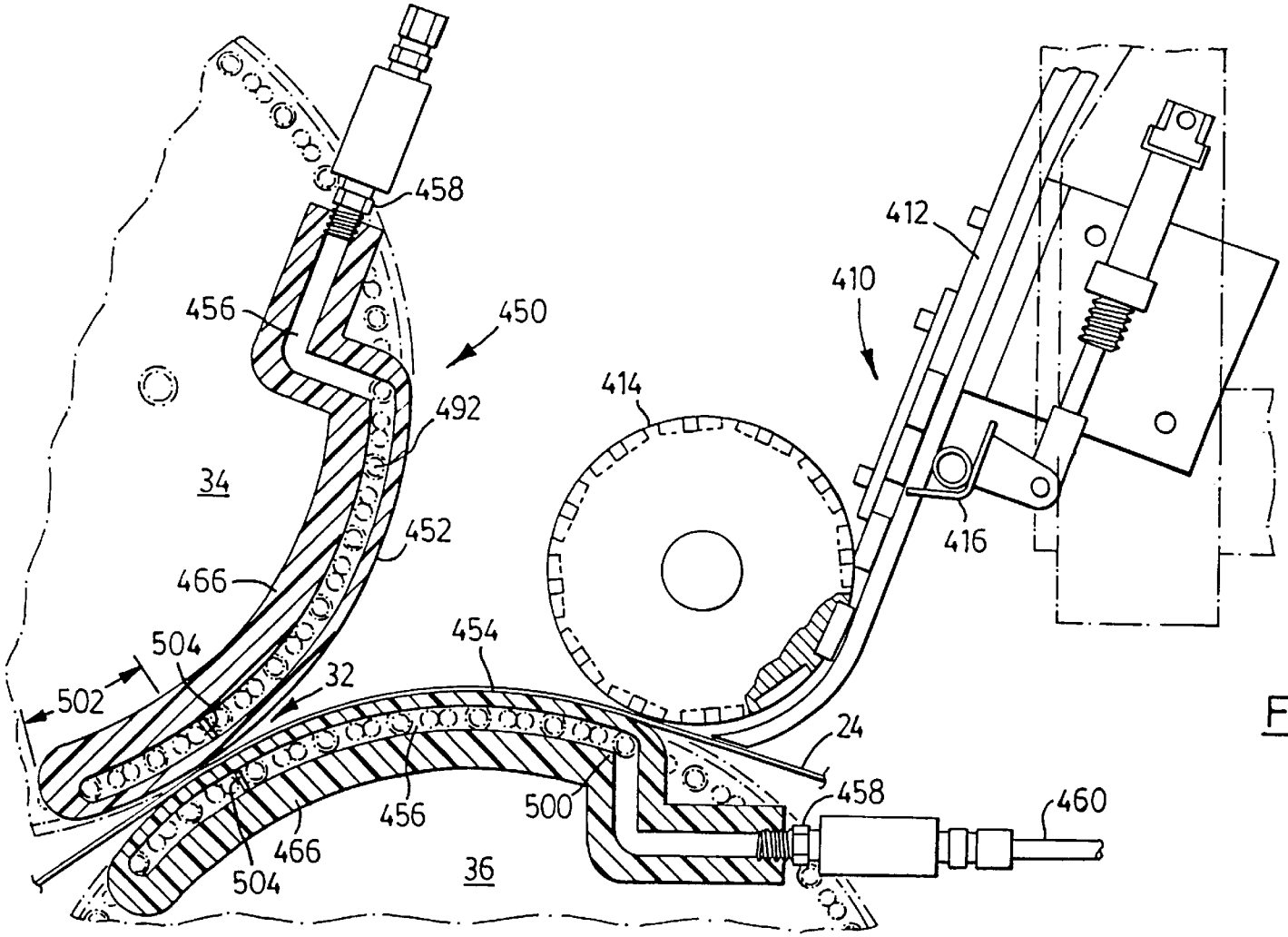
FIG. 14 is a side elevation showing the nip region of a second embodiment of the apparatus for enrobing tablets, this apparatus employing vacuum applying devices.

An alternative form of tablet transfer device 410 is illustrated in FIG. 14. This transfer device is described and illustrated in applicant's co-pending U.S. patent application filed January 29, 1999, Ser. No. 06/167,684 filed Jan. 2, 2001 the specification of which is incorporated by reference. Briefly, this transfer device includes an elongate pill chute 412 capable of holding a number of pills in vertically extending rows, a plunger mechanism (not shown) for temporarily engaging one of the pills in each chute, a rotatable feed roll 414 located adjacent a bottom end section of the chute, and a stop mechanism 416 for preventing temporarily downward movement of a bottom pill of each row of pills in the chute. The stops mechanism moves to a pill releasing position when the plunger mechanism is engaging one of the pills in the respective chute, this pill being located directly above the bottom pill in the chute. The stop mechanism prevents downward movement of the rows of pills when the plunger mechanism is moved to a position of disengagement from any pill in the chute.

Figure 6A:
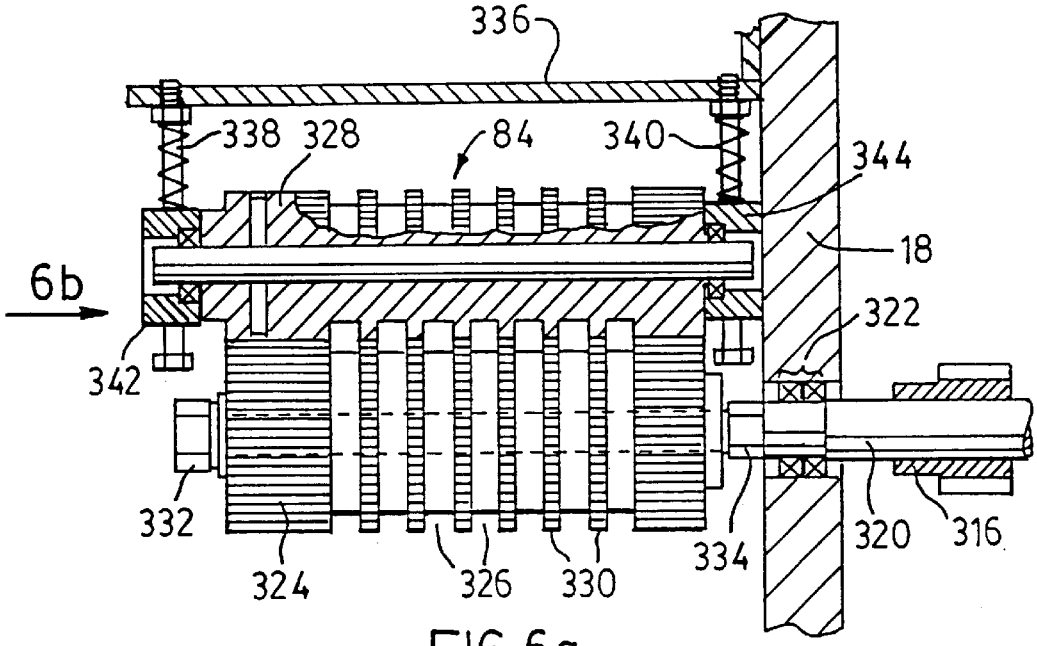
FIG. 6*a* is a cross-sectional elevation taken along the line 6*a*—6*a* of FIG. 6*b* showing a scrap ribbon roller and cooperating spring loaded roller mounted downstream of the rotary die assemblies.
Figure 6B:
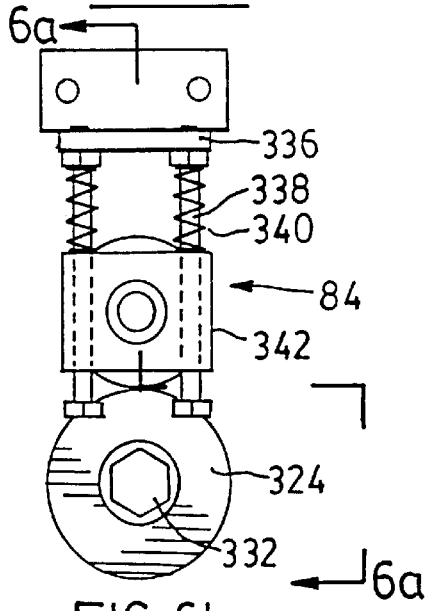
FIG. 6*b* is a left end view of the rollers of FIG. 6*a* and the mounting therefor.

Turning now to the construction of the scrap ribbon puller 84 illustrated in FIGS. 6*a* and 6*b*, this device is driven by a gear train illustrated in FIG. 1 from the main drive shaft 96. In particular, the main drive gear 108 drives a small idler gear 309 which in turn drives two similar, larger idler gears 310, 311. The idler gear 311 drives small gear 316 which in turn drives a larger idler gear 314, the purpose of which is described later herein. The gear 316 drives a scrap ribbon roller 324 shown in FIG. 6*a*. It will be appreciated that this gear train is rotatably supported by shafts extending through and mounted in the front plate 18.

Shown in FIG. 6*a* is front plate 18 through which extends drive shaft 320 on which the gear 316 is mounted. A pair of ballbearings at 322 support the shaft in the plate 18. The scrap ribbon roller 324 is mounted on the shaft 320 for rotation therewith and this roller has a number of circumferential grooves 326 spaced evenly apart. These grooves are provided to permit any tablets that remain on the scrap ribbon to pass through the nip formed by the roller and adjacent spring loaded roller 328 (shown in cross-section). Small gripping teeth can be formed on the ridges 330 in order to enable the roller to hold onto and pull the scrap ribbon better. A nut 332 and suitable washers hold the roller in place on the shaft 320. An annular spacer 334 helps keep the roller in position.

The upper spring loaded roller has grooves which are aligned with the grooves 326 and the ridges which form the grooves also have gripping teeth. The roller 328 is supported by means of a horizontal support bracket 336 connected to front plate 18 and four downwardly extending posts 338 about which extend coil springs 340 used to spring load the roller. The posts are threaded into the bracket 336 from below. On the posts are mounted two bearing holders 342, 344. Roller bearings are mounted in the holders to rotatably support the roller 328. It will be appreciated that the upper roller 328 acts to press downward on the scrap ribbon so that the scrap ribbon is firmly gripped between this roller and the roller 324. Both these rollers can be made from aluminum.

The encapsulated tablets normally fall from the die blocks 40 after they pass through the nip. Those tablets which remain in the recesses in the die blocks are removed from the recesses by means of knock-out brushes 350 and 352 which sweep across their respective series of die blocks. The position of these brushes is indicated in FIG. 1.

Separate gear trains can be provided to rotate each of the brushes 350 and 352, the gear train for the upper brush 350 being driven by the idler gear 202 and the gear train for the lower brush 352 being driven by the gear 316. The gear 202 drives a series of three small gears 400 to 402 with the last gear 402 being mounted on the same shaft as the brush 350. The first gear 400 can also be used to rotate the oil roller 82, if desired. The gear 316 drives a series of four gears 314 and 404 to 406 with the gear 314 being substantially larger than the other gears. The small gear 406 is mounted on the same shaft as the brush 352. It will be understood that the rotatable shafts for both of these gear trains are mounted in the front plate 18.

In order to ensure that the two gel strips 24 and 28 are heated to an adequate temperature for the encapsulation step, a heat light 354 can be located above the gel strip 24 at the location indicated in FIG. 1. In one preferred embodiment, this location is about twelve inches away from the nip where the two gel ribbons meet. The heat light can be rigidly mounted on the front plate 18. It will be appreciated that the heat light heats the gelatin strip 24 sufficiently so that it becomes sticky and pliable so that when the tablets are dropped onto the strip, they will stick to it and remain in place as they pass through the nip. A separate heat light can be provided to heat the strip 28 if the single light 354 is not sufficient for this purpose.

Mounted adjacent the perimeter of the lower die rotating assembly 36 is an electronic sensor 356 which per se can be of standard construction. This sensor accurately senses the rotational position of the die blocks 40 on the assembly 36. This sensor is connected to a programmable logic controller (not shown) which also can be a standard type of controller suitable for controlling the operation of the above described tablet transfer device 250 and vacuum applying members 254. This logic controller controls the operation of the first and second air cylinder drive devices 282 and 284 and the application of vacuum to the members 254 so that these devices will know when to pick up tablets from the bottom end of the chute, transfer them to the moving gelatin strip 24 and release them.

After the encapsulated tablets are formed by the rotating die assemblies, the tablets will normally fall under the force of gravity into a container 360 provided below the downwardly moving section of the scrap ribbon as shown in FIG. 1. Tablets which remain stuck on the scrap ribbon will be able to pass through the scrap ribbon roller 84 because of the grooves formed therein.

In addition to the heat light(s) 354 for heating the gelatin strips, there can be provided other conditioning means for the gelatin strips so that they have a predetermined deformability and adhesivity to the tablets and to each other. For example, the entire apparatus 10 is best located in an air conditioned room so that temperature and humidity may be controlled to maintain the desired condition of the films.

Figure 15:
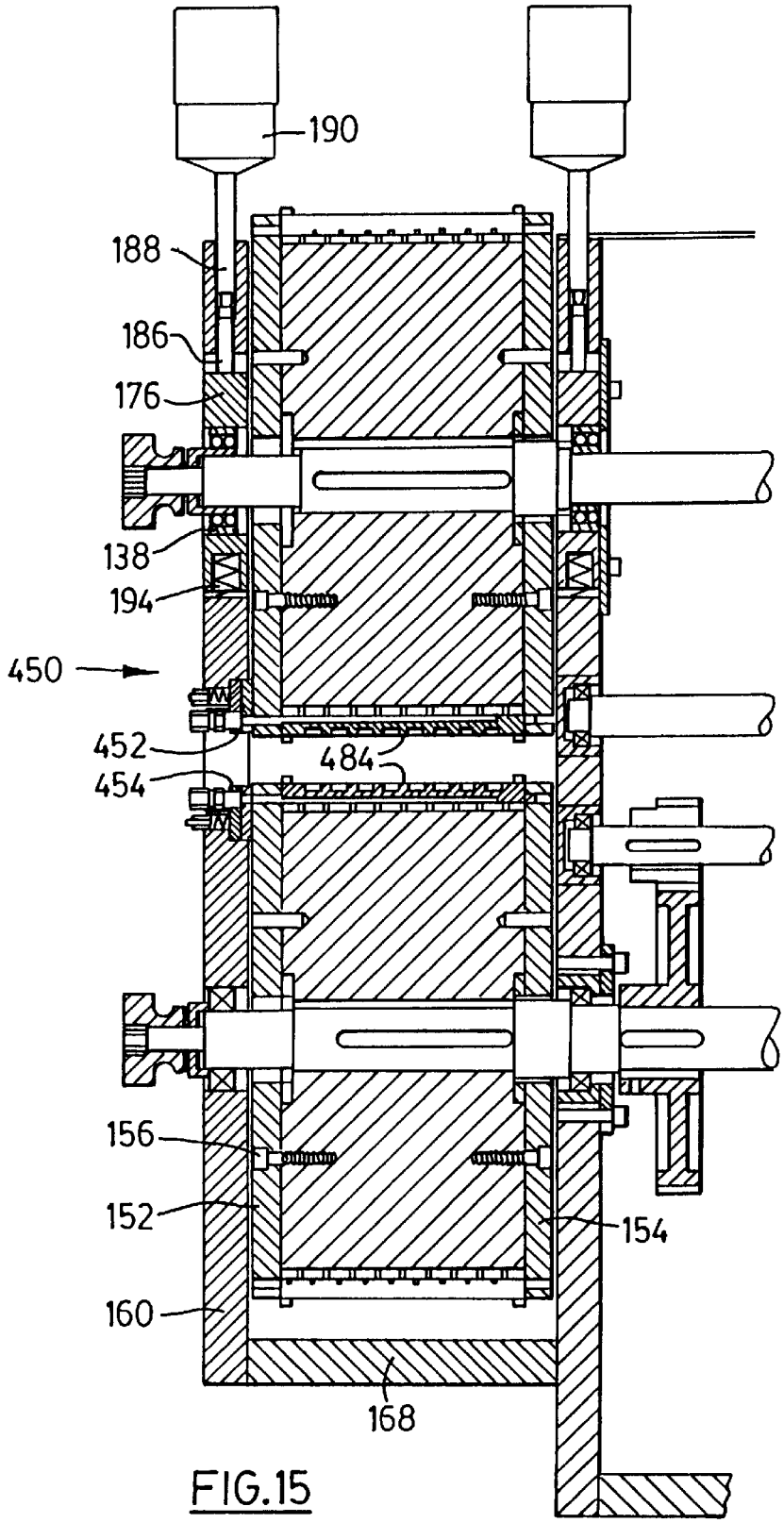
FIG. 15 is a cross-sectional view similar to FIG. 5 but illustrating the second embodiment of the invention and its vacuum applying devices.
Figure 16:
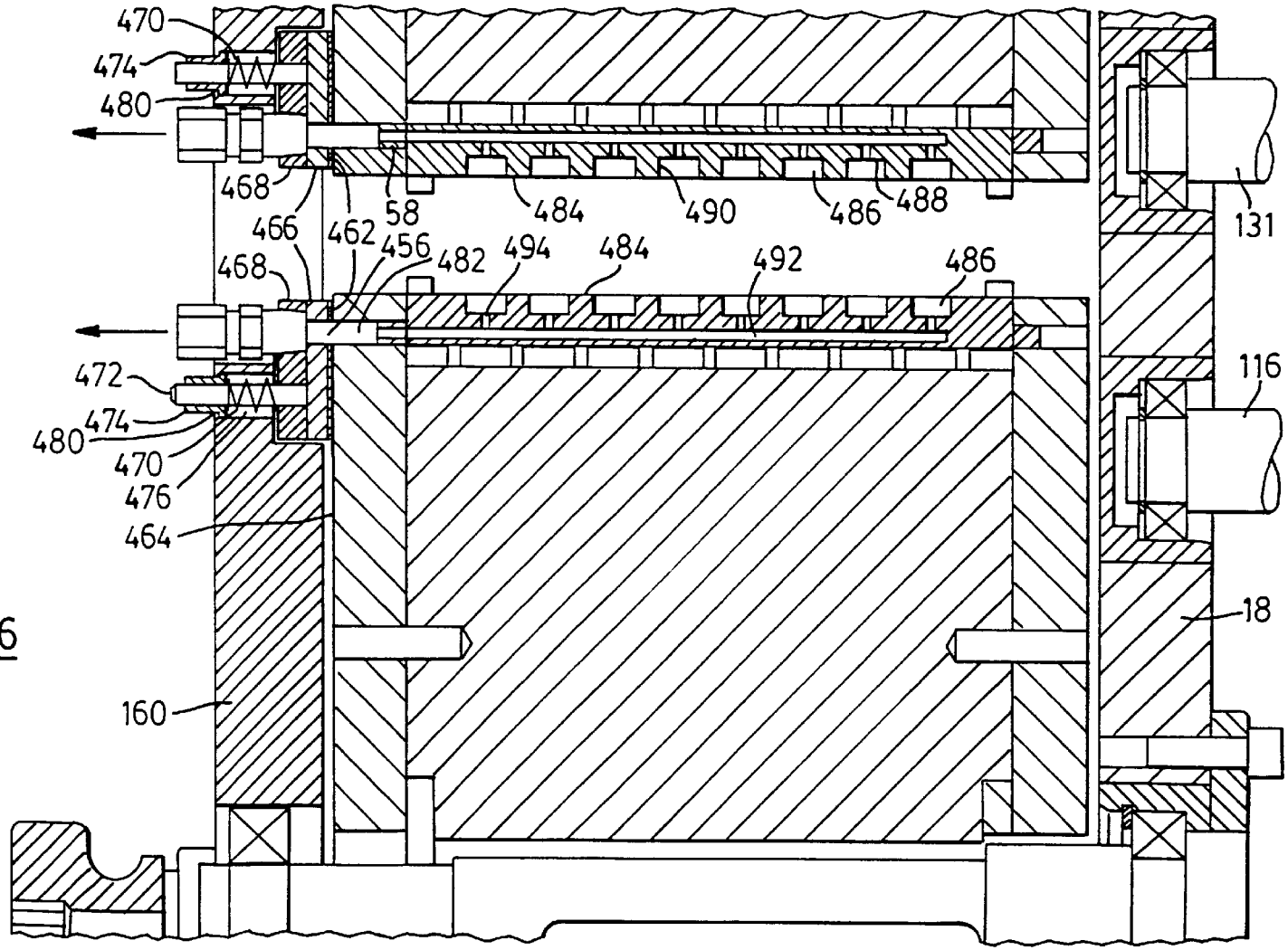
FIG. 16 is a cross-sectional detail view showing the construction of the die blocks in the second embodiment.

A second embodiment for an apparatus for enrobing tablets in a gelatin layer is illustrated in FIGS. 14 to 16. This apparatus 450 is similar in its construction in many ways to the apparatus 10 described above. Accordingly, only those features which differ from the apparatus 10 will be described in detail hereinafter. The apparatus 450 differs from the apparatus 10 in that it employs vacuum applied to the die blocks as they approach the nip of the rotary die assemblies in order to stretch portions of the gelatin webs and pull these portions into adjacent cavities in order to form tablet receiving cups or recesses in the gelatin web. In order to accomplish this vacuum step in the preferred apparatus 450, there are two vacuum applying devices 452 and 454 each mounted adjacent a respective one of the two rotary die assemblies and connected to a vacuum source (not shown). Thus, as shown in FIG. 14, the vacuum applying device 452 is mounted adjacent the upper rotary die assembly 34, on one side thereof while the vacuum applying device 454 is mounted adjacent the lower rotary die assembly 36. As these two devices can be of similar or identical construction, only the device 36 is described in detail herein. The preferred vacuum applying device extends along a circumferential arc which ends at a location adjacent the nip 32 or which extends a short distance beyond the nip as illustrated in FIG. 14, although vacuum is not applied to the die blocks beyond the nip itself. Each vacuum device has a primary vacuum applying passageway 456 that extends along the length of the device and is operatively connected to vacuum applying passageways in the plastic blocks when they are rotated along and next to the vacuum applying device. A threaded metal connector member 458 can be threaded into the device 454 at the open end of the passageway 456 to permit attachment of a vacuum hose 460 which extends to a suitable vacuum source that can be of standard construction.

Each vacuum applying device 452, 454 preferably comprises a substantially flat member having a friction reducing coating 462 on the inner side thereof (see FIG. 16). The preferred coating is tetrafluoroethylene polymer such as that sold under the trade-mark TEFLON and preferably the material is pharmaceutical grade Teflon. The coated inner side engages a flat side 464 of the rotary die assembly and is slidable thereon during rotation of the die assembly. Also the preferred vacuum applying device is made with two adjacent, flat plates 466 and 468 which can be securely attached to each other in any suitable manner such as by welding or by adhesive. These two plates can be seen clearly in FIG. 16 which is on a larger scale. The primary vacuum applying passageway 456 is formed in the innermost plate 466 with the outer wall of this passageway being formed by the outer plate 468. Two or more coil springs 470 are preferably used to engage an outer side of each vacuum applying device 452, 454, these springs acting to bias the substantially flat device towards and into engagement with the flat side 464 of the rotary die assembly. Each spring 470 extends around a short support pin 472, one end of which can be mounted in the outer plate 468. Each pin 472 is free to slide in a sleeve guide 474 which is mounted at one end of cylindrical cavity 476 formed in the bracket plate 160. As the sleeve guide 474 is formed with an inner end flange, it cannot pass out through a circular opening 480 formed in the bracket plate 160. It will thus be seen that the inner end of each spring 470 applies a biasing force against the outer surface of the plate 468, thus keeping the vacuum applying device pressed against the flat side of the rotary die assembly. Also, a vacuum passageway 482 is formed in the adjacent rotary die assembly beside the primary vacuum passageway 456, thus permitting vacuum to be applied to the modified plastic die blocks 484.

Turning now to the construction of these modified die blocks 484, it will be appreciated that these die blocks can be similar in their construction to the die blocks 40 described above and only the differences in their construction will be described hereinafter. These die blocks have a number of tablet receiving recesses 486, each of which has a bottom 488 and at least one side wall 490 forming a substantially enclosed recess with an open top. Each block 484 has one or more vacuum applying passageways opening into the recesses 486. In the illustrated preferred block, there is one long vacuum applying passageway 492 that extends from an open end adjacent the short vacuum passageway 482 to almost the opposite end of the block. This long passageway is connected by means of a number of short passageways 494 to the recesses 486. It will thus be seen that these passageways 494 and 492 are connectible to the aforementioned vacuum source during operation of this apparatus and, in particular, during the time period when the blocks are approaching the nip 32. In the preferred illustrated embodiment, one end of the long passageway 492 extends through one of the three cylindrical protrubences at the end of the block, preferably the central protuberance 58.It will be understood that the block 484, like the first described block, is provided with laterally projecting connecting members formed on two opposite ends of the die block for connecting the die block to connecting members, preferably in the form of the described connecting rings, used to connect the die block to a number of other similar die blocks.

As illustrated in FIG. 14, in the preferred embodiment, the lower vacuum applying device 454 initially provides vacuum to the die blocks at a location 500 near the tablet dispensing mechanism. Thus, as the tablet is delivered to the gelatin web 24, a cup or recess is quickly formed in the web at each recess in the passing die block. In this way, the tablets are held securely in place in each of the respective cavities as they are rotated into the nip 32. In other words, each dispensed tablet is held in a stretched portion of the gelatin strip as it moves with the strip into the nip. As soon as the tablet reaches the nip and is covered on both sides with a gelatin layer, the vacuum is released or removed so that it will not interfere with the completion of the enrobed tablet.

If desired, pressurized air can be used to help remove the covered tablets from the cavities in the die blocks after they are enrobed at the nip. This pressurized air can be introduced into the cavities of the die blocks through separate end portions of the aforementioned passageways 492 and 494. The pressurized air can be introduced into the die blocks with the use of either the vacuum employing devices 452 or 454 or by means of separate, pressurized air applying devices constructed in a similar manner to the devices 452, 454 but substantially shorter. In the case where the vacuum applying devices 452, 454 are used, a pressurized air hose can be attached to each of these devices in the tail region 502 indicated in FIG. 14. It will be understood that whether or not pressurized air is used, the vacuum applying passageway 456 is terminated adjacent the nip, that is at the point 504. The portion of each passageway 456 that extends beyond the passage closure or passage end at 504 can be used for the application of pressurized air to the cavities. If the use of pressurized air is not required, then the tail section 502 of the vacuum applying device need not be provided and openings can simply be provided in the circumference of the rotary die assembly to permit air to quickly enter the passageways 492 in the blocks, thereby preventing any vacuum in the block cavities.

It will be further appreciated that it is possible to omit the upper vacuum applying device 452 entirely, if desired, and to only apply vacuum to the blocks of the lower rotary die assembly 36. With this version, the upper web 28 will remain relatively flat over the top of the die cavities until it reaches the nip 32 where the introduction of the top halves of the tablets will cause the upper gelatin web to be stretched in each cavity. It is also possible, although less preferred, to apply a vacuum only to the upper rotary die assembly by means of the vacuum applying device 452 and to have no vacuum applied to the blocks of the lower rotary die assembly. In such an embodiment, one would simply rely upon the tackiness of the lower gelatin web 24 to hold the tablets in place over their respective cavities as they move from the tablet dispensing mechanism to the nip.

It will be appreciated by those skilled in the art that various modifications and changes can be made to the described apparatus for enrobing tablets and to the described die blocks without departing from the spirit and scope of this invention. For example, instead of employing the tablet dispensing mechanism illustrated in FIGS. 12 and 13, one could employ known tablet dispensing mechanisms such as that illustrated in FIG. 26 of U.S. Pat. No. 5,459,983, the specification and drawings of which are incorporated herein by reference. In this known dispenser, the preforms pass through chutes and an eccentric cam mounted on a drive shaft extends into each tubular chute through a side opening and contacts a tablet in the chute. The cam contour is defined in combination with the rate of rotation of its shaft to engage a tablet in the chute each time a row of recesses in the die blocks 40 reaches a desired position and to drive the tablets in each chute a desired distance along the chutes, this distance being sufficient to permit the end tablet in each chute to drop out of the chute and onto the passing web. A resilient element, ie. a leaf spring, is mounted at the bottom end of each chute to hold the lowermost tablet in the chute until the aforementioned cam operation forces it past the resilient element.

As indicated, many variations of this invention will suggest themselves to those skilled in this art. Accordingly, all such modifications and changes as fall within the scope of the appended claims are intended to be part of this invention.

I claim:

1. A die block for use in an apparatus for enrobing ingestible tablets of selected size and shape with a gelatin film, said block having a top, a bottom, and sides extending between said top and said bottom, a number of similar recesses formed in said top with each recess being dimensioned to receive loosely therein at least one half of one of said tablets, and a raised rim extending about a perimeter of each recess for cutting a gelatin film laid over the top of said block during use of the block, wherein each recess has an aperture in a bottom thereof to permit air to escape from said recess after said gelatin film is laid over the top of said block and at least one half of a tablet is inserted into that respective recess, wherein said block is made of a hard plastics material and includes two or more rows of teeth formed on said bottom of said block for engagement with at least one circumferential row of teeth formed on a substantially cylindrical, rotatable die support, said die block further including laterally projecting connecting members molded on two opposite ends of said die block and adapted to connect the die block to two metal ring members that connect said die block to a number of other similar die blocks.

2. A die block according to claim 1 wherein said die block consists essentially of carbon reinforced plastics material.

3. The apparatus according to claim 1 wherein said die block is made of carbon reinforced, heat stabilized polyphthalamide.

4. The apparatus according to claim 1 wherein said recesses each have a bottom and at least one sidewall forming a substantially enclosed recess with an open top and said block has one or more vacuum applying passageways opening into said recesses, said passageways being connectable to a vacuum source during operation of said apparatus.

5. A die block according to claim 4 wherein said one or more vacuum applying passageways include a relatively long passageway having an open end at one end of said die block and a number of additional short passageways each extending between one of said recesses and said long passageway.

6. A die block for use in an apparatus for enrobing ingestible tablets of selected size and shape with a gelatin film, said block having a top, a bottom, and sides extending between said top and said bottom, a number of similar recesses formed in said top with each recess being dimensioned to receive loosely therein at least one half of one of said tablets, and a raised rim extending about a perimeter of each recess for cutting a gelatin film laid over the top of said block during use of the block, wherein said block is made of a hard plastic material, and wherein said die block includes die locating members projecting upwardly from opposite ends of the top of the die block and helping to align the die block with another cooperating die block of said apparatus during use thereof.

7. A die block for use in an apparatus for enrobing tablets of selected size and shape with an ingestible film, said block having a top, a bottom and sides extending between said top and said bottom, a number of similar recesses formed in said top with each recess being dimensional to receive therein at least one half of one of said tablets, and a raised rim extending around a perimeter of each recess for cutting a gelatin film laid over the top of said block during use thereof, wherein each recess has a bottom and at least one sidewall forming a substantially enclosed recess with an open top and said block has two opposite ends and one or more vacuum applying passageways opening into said recesses, including an initial passageway having an open end at one end of said die block, wherein said bottom of said block is closed so as to prevent air form passing through said bottom and into said recesses.

8. A die block according to claim 7 wherein said initial passageway is relatively long and extends almost from one end of the block to the opposite end thereof, and said one or more passageways include a number of short connecting passageways each extending between the initial passageway and a respective one of the recesses.

9. A die block according to claim 7 wherein said die block is molded from carbon reinforced plastics material.

10. A die block for use in an apparatus for enrobing tablets of selected size and shape with an ingestible film, said block having a top, a bottom and sides extending between said top and said bottom, a number of similar recesses formed in said top with each recess being dimensional to receive therein at least one half of one of said tablets, and a raised rim extending around a perimeter of each recess for cutting a gelatin film laid over the top of said block during use thereof, wherein each recess has a bottom and at least one sidewall forming a substantially enclosed recess with an open top and said block has two opposite ends and one or more vacuum applying passageways opening into said recesses, including an initial passageway having an open end at one end of said die block, wherein said die block includes laterally projecting connecting members formed on said two opposite ends of the die block and adapted to connect said die block to connecting members used to connect the die block to a number of other similar die blocks.

11. An apparatus for enrobing tablets in a gelatin layer, said apparatus comprising:

a pair of cylindrical, rotary die assemblies, each die assembly including a substantially cylindrical, rotatable die support and a series of die blocks mounted on said die support for rotation about a central axis of the die support, each block having at least one recess formed in a top surface thereof and each recess of one die assembly being cooperable with a similar recess in the other die assembly to form a cavity at a nip formed by said die assemblies, each cavity being dimensioned to receive therein one of the tablets, the blocks of at least one of said rotary die assemblies each having one or more vacuum applying passageways that open into said at least one recess;

a drive system for rotating both die assemblies around their respective central axes so that the two series move in synchronism with each other;

feed means for delivering a gelatin strip of selected thickness and composition respectively to each of said die assemblies, whereby during use of the apparatus, each gelatin strip is pulled by a respective one of said die assemblies into said nip and is laid on a section of the series of die blocks of the respective die assembly;

a tablet dispensing mechanism for dispensing individual whole tablets onto one of said gelatin strips at a feeding location that is upstream of said nip; and a vacuum applying device mounted adjacent at least one of said rotary die assemblies and connectible to a vacuum source, said vacuum applying device extending along a portion of the circumference of the at least one rotary die assembly to a location adjacent said nip and having a primary vacuum applying passageway extending therealong, said primary vacuum applying passageway being operatively connected to the vacuum applying passageways in some of said blocks when they are rotated towards the nip, wherein during use of the apparatus, a portion or portions of at least one of said gelatin strips are stretched in said at least one recess by vacuum applied to said at least one recess by means of said vacuum applying device and the one or more vacuum applying passageways in the respective block.

12. An apparatus according to claim 11 wherein each die block of each series has a number of recesses arranged in one or more rows extending transversely of its respective die assembly and is made of a hard plastics material.

13. An apparatus according to claim 11 wherein each die block of each series is formed with two or more rows of teeth on a bottom thereof and each die support includes a series of teeth extending about the circumference of the die support and adapted to engage said rows of teeth on the blocks in order to move the series of blocks with its respective die support.

14. An apparatus according to claim 12 including means for connecting together each series of die blocks, said connecting means comprising two metal rings detachably engaged with two opposite sides of the series of die blocks and mounted on the respective die support for rotation therewith.

15. An apparatus according to claim 11 wherein said vacuum applying device is a substantially flat member having a friction reducing coating on one side thereof, said one side engaging a flat side of said at least one rotary die assembly and slidable thereon during rotation of the die assemblies.

16. An apparatus according to claim 15 including springs mounted to engage an outer side of said substantially flat member and biasing said substantially flat member towards and into engagement with said flat side of said at least one rotary die assembly.

17. An apparatus for enrobing tablets in a gelatin layer, said apparatus comprising:

a pair of cylindrical, rotary die assemblies, each die assembly including a substantially cylindrical, rotatable die support and a series of die blocks mounted on said die support for rotation about a central axis of the die support, each block having at least one recess formed in a top surface thereof and each recess of one die assembly being cooperable with a similar recess in the other die assembly to form a cavity at a nip formed by said die assemblies, each cavity being dimensioned to receive therein one of the tablets, the blocks of both rotary die assemblies each having one or more vacuum applying passageways that open onto said at least one recess;

a drive system for rotating both die assemblies around their respective central axes so that the two series move in synchronism with each other;

feed means for delivering a gelatin strip of selected thickness and composition respectively to each of said die assemblies, whereby during use of the apparatus, each gelatin strip is pulled by a respective one of said die assemblies into said nip and is laid on a section of the series of die blocks of the respective die assembly;

a tablet dispensing mechanism for dispensing individual whole tablets onto one of said gelatin strips at a feeding location that is upstream of said nip; and two vacuum applying devices each mounted adjacent a respective one of the rotary die assemblies and connectible to a vacuum source, each vacuum applying device extending along a circumferential arc on one side of its respective die assembly to a location adjacent said nip and each having a primary vacuum applying passageway extending therealong and operatively connected to the vacuum applying passageways in the blocks when the blocks are rotated along and next to the vacuum applying device;

wherein portions of said gelatin strips are stretched in the recesses of the blocks by vacuum applied to the recesses by means of said vacuum applying devices and the vacuum applying passageways in the blocks, each dispensed tablet being held in a stretched portion of said one gelatin strip as the tablet moves into the nip where it is enrobed by stretched portions of both strips.

18. An apparatus according to claim 17 wherein each die block of each series has a number of recesses arranged in one or more rows extending transversely of its respective die assembly and is made of a hard plastics material.

19. An apparatus according to claim 17 wherein each die block of each series is formed with two or more rows of teeth on a bottom thereof and each die support includes a series of teeth extending about the circumference of the die support and adapted to engage said rows of teeth on the blocks in order to move the series of blocks with its respective die support.

20. An apparatus according to claim 19 including means for connecting together each series of die blocks, said connecting means comprising two metal rings detachably engaged with two opposite sides of the series of die blocks and mounted on the respective die support for rotation therewith.

21. An apparatus according to claim 17 wherein each vacuum applying device is an elongate, rigid member having an inner surface coated with a friction reducing material, said inner surface slidingly engaging a flat side of the respective rotary die assembly.

* * * * *

UNITED STATES PATENT AND TRADEMARK OFFICE

CERTIFICATE OF CORRECTION

PATENT NO. : 6,209,296 B1
DATED : April 3, 2001
INVENTOR(S) : Perrone

It is certified that error appears in the above-identified patent and that said Letters Patent is hereby corrected as shown below:

Column 9,
Lines 63-64, should read: -- filed January 29, 1999, now U.S. Patent No. 6,167,684 issued on Jan. 2, 2001 --

Signed and Sealed this

Second Day of October, 2001

*Attest:*

Nicholas P. Godici

*Attesting Officer*

NICHOLAS P. GODICI
*Acting Director of the United States Patent and Trademark Office*